United States Patent [19]

Jaffe

[11] Patent Number: 4,764,043

[45] Date of Patent: Aug. 16, 1988

[54] DEVICE FOR MARKING SHEET-SHAPED OBJECTS

[75] Inventor: Walter Jaffe, Lidköping, Sweden

[73] Assignee: Fleximark AB, Goteborg, Sweden

[21] Appl. No.: 12,129

[22] PCT Filed: Apr. 18, 1986

[86] PCT No.: PCT/SE86/00178

§ 371 Date: Dec. 16, 1986

§ 102(e) Date: Dec. 16, 1986

[87] PCT Pub. No.: WO86/06329

PCT Pub. Date: Nov. 6, 1986

[30] Foreign Application Priority Data

Apr. 19, 1985 [SE] Sweden ..... 8501917

[51] Int. Cl.[4] ..... B41J 13/12

[52] U.S. Cl. ..... 400/629; 400/635; 400/625

[58] Field of Search ..... 101/37, 44, 279, 280, 101/11, 232; 400/628, 629, 635, 624, 625, 636; 271/232, 264, 271, 275, 109, 114, 31.1, 117, 118, 149

[56] References Cited

U.S. PATENT DOCUMENTS 4,147,341 4/1979 Wurscher et al. ..... 271/281 X
4,160,606 7/1979 Coenazzo ..... 400/616.2
4,440,387 4/1984 Ikoma et al. ..... 271/227 X
4,505,467 3/1985 Brocklehurst ..... 271/31.1 X

OTHER PUBLICATIONS

I.B.M. Technical Disclosure Bulletin, vol. 15, No. 7, 12/72, "Antitreeing Device for Paper Feed Mechanisms", Brown, p. 2311.

*Primary Examiner*—Edgar S. Burr
*Assistant Examiner*—Huong Q. Pham
*Attorney, Agent, or Firm*—Cushman, Darby & Cushman

[57] ABSTRACT

A device for marking of comparatively stiff, bendable sheets (21) by of a stationary write head (3), which sheets are displaceable relative to the write head (3) along a linear guiding path (12, 13), comprising a feeding device (27) for feeding the sheets one at time from a magazine (9). The sheets (21) are arranged to cooperate with a guiding member (17) movable to-and-fro in the longitudinal direction of the guiding path (12, 13) by the driving device (28). The feeding device (27) has a sliding track (8) which inclines against the guiding path (12,13) and arranged in connection to the magazine (9). In the extension of the sliding track (8) above the guiding path (12, 13) there is arranged a driving wheel (24) for feeding the front edge of the sheets (21) along the guiding path until the rear edge of the sheets leave the sliding track and are completely located on the guiding path and in cooperation with the guiding device (17).

4 Claims, 3 Drawing Sheets

DEVICE FOR MARKING SHEET-SHAPED OBJECTS

The present invention relates to a device for marking of comparatively stiff, bendable sheets by means of a stationary write head, which sheets by means of a drive mechanism are displaceable relative to the write head along a linear guiding path, and which device comprises a member for feeding sheets one at time from a magazine.

BACKGROUND OF THE INVENTION

On the market today there can be found different types of marking systems for electrical wires, pipes and the like. There are rules for how these markings should be performed and what they should look like, and the markings must be made so as to be as permanent as possible. When marking larger installations, as for example parts in a large machine or a complete construction, it is very important to have control such that all wires really become marked.

SUMMARY AND ADVANTAGES OF THE INVENTION

The purpose of the present invention is to achieve a system for marking of a stiff yet bendable sheet, which system is economical, simple and reliable. The system also very rapidly produces a large number of sheets. Another purpose is to achieve a feeding means for the sheets. In the feeding means the sheets are arranged to cooperate with guide member movable to-and-fro in the longitudinal direction of a guide path by a driving device. The feeding means includes a slide track which is inclined relative to the guide path and is connected to a magazine. Downstream of the slide track at a location above the guide path there is arranged a driving wheel for feeding the front edge of each sheet along the guide path until the rear edge of the sheet leaves the slide track and is completely located on the guide path and in cooperation with the guiding device.

DESCRIPTION OF THE DRAWINGS

The invention will in the following be described with reference to the enclosed drawings.

DETAILED DESCRIPTION

Figure 1:
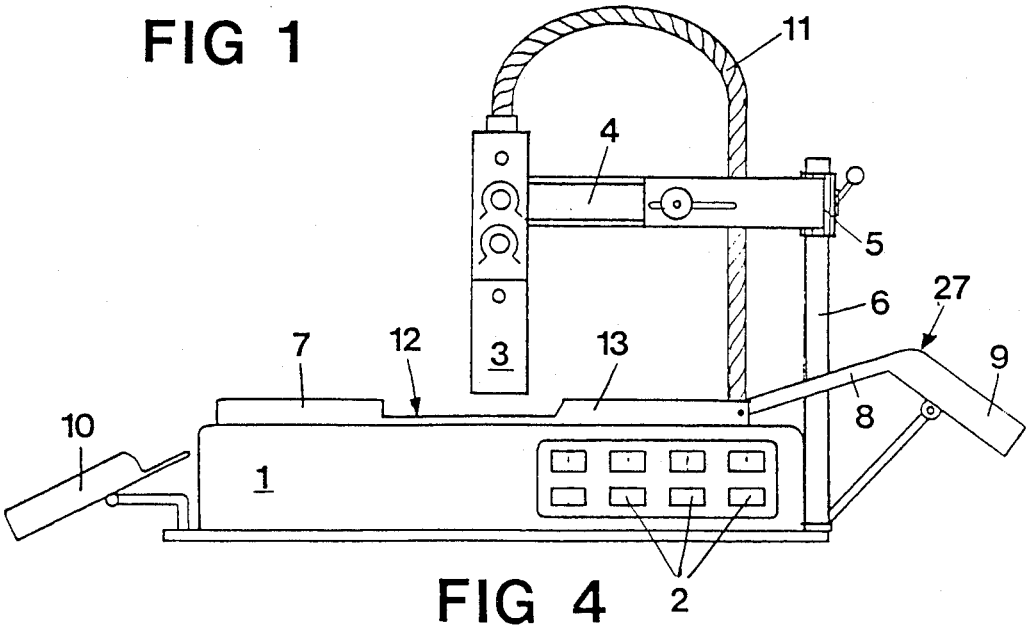
FIG. 1 is a side view of a marking device according to the invention.

The device according to the invention includes a table 1 with a control panel 2 and a write head 3, for example on ink beam writer arranged above the table. The ink beam writer is fixed on a telescopically displaceable arm 4, which is vertically adjustable by means of a sleeve clamp 5 arranged on a pillar 6. On the table 1 a plate 7 is arranged, which plate can be adjusted in horizontal direction (Y-direction) by means of a stepping motor 26 along guides 29 (FIG. 3) by means of an endless band 30. Above the plate 7 there is arranged a feeding device 27, including a sliding track 8 which leads downwardly form a magazine 9, for sheets 21. At the other end of the table 1 there is arranged a collecting receptacle 10 for the sheets 21. To the head 3 of the ink beam writer there is connected a plurality of wires 11, which are connected to equipment (not shown) for supplying ink to the ink beam writer. The table is controlled by means of a computer (not shown) for example a IBM PC.

Figure 4:
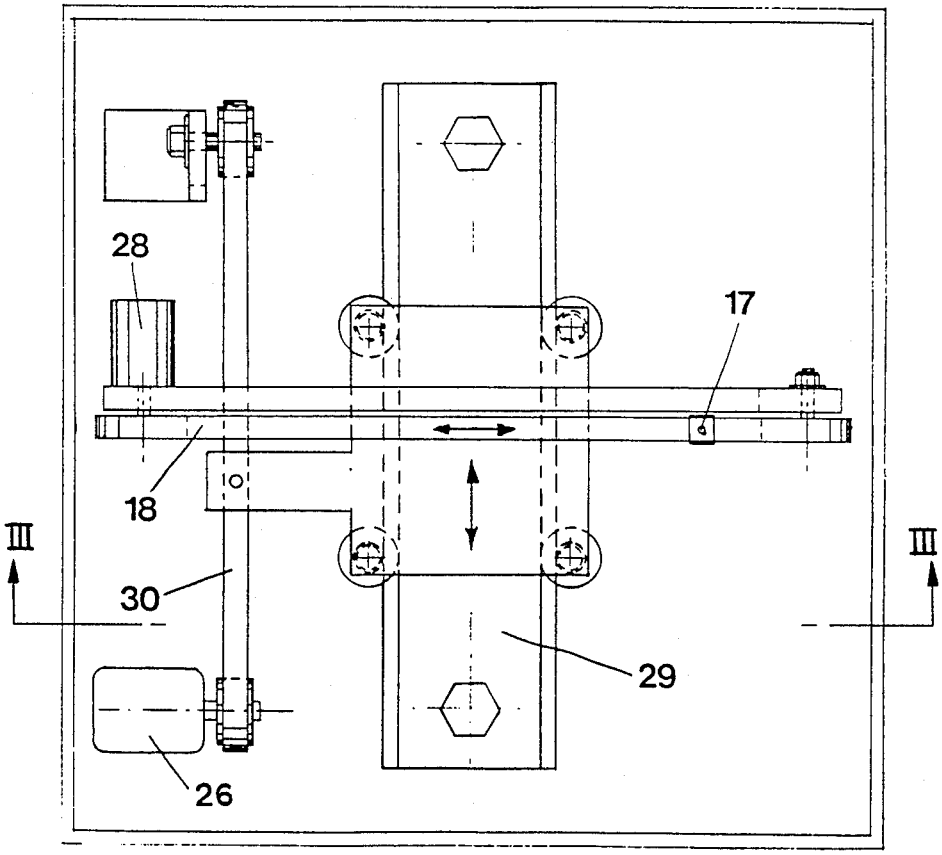
FIG. 4 is a plan view, with some parts omitted, showing the drive mechanism of the device.
Figure 2:
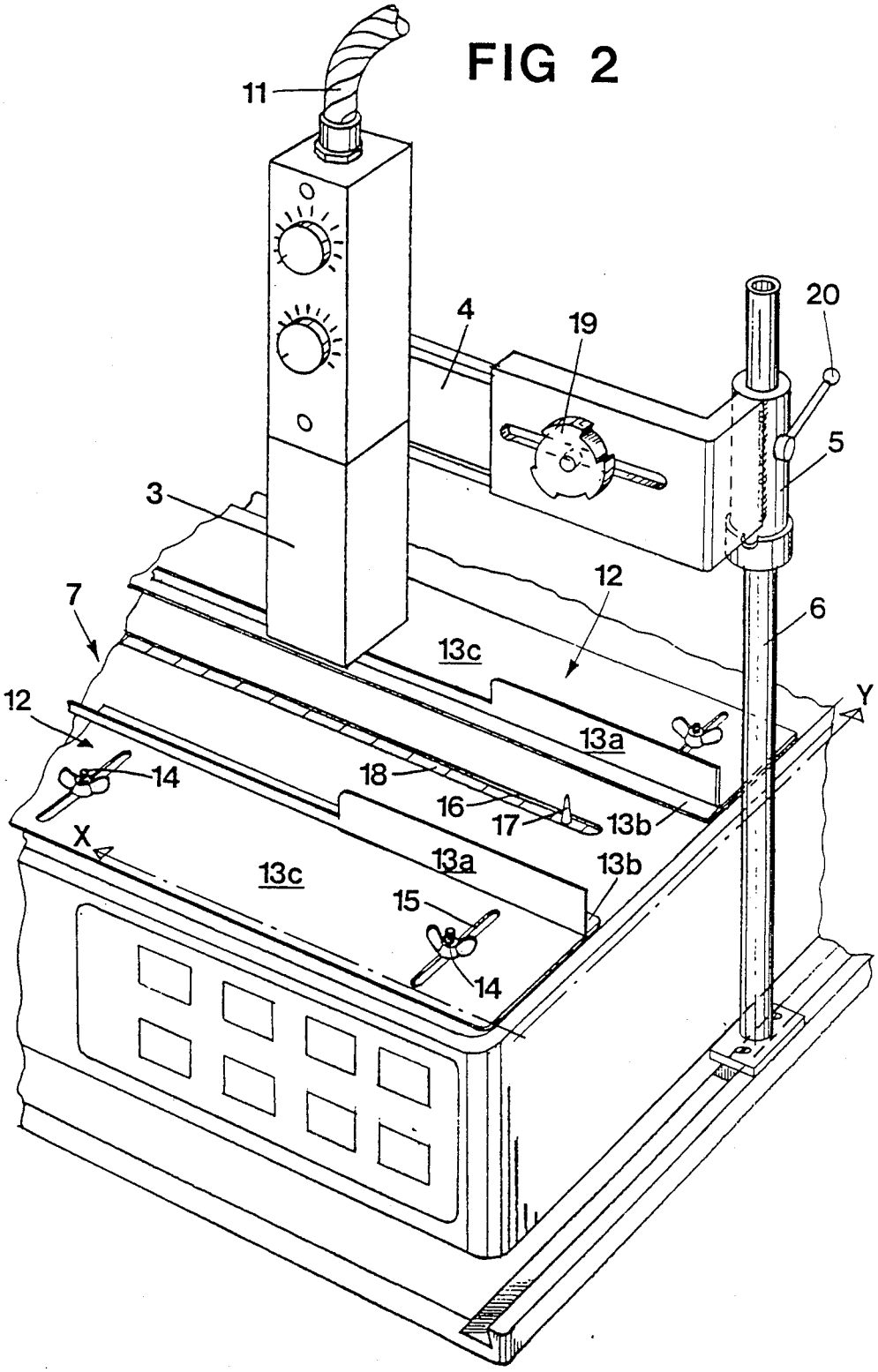
FIG. 2 is a perspective view obliquely from above of a part of the marking device in accordance with FIG. 1.

In FIG. 2 a part of the plate 7 arranged on the table 1 is shown more in detail. On the plate 7 there is arranged a guide assembly for guiding sheets along a path. The assembly includes two T-shaped rules 12, T-shaped in cross section, each provided with an upright guiding flange **13*a* and horizontal side shanks 13*b*. The rules 12 can be adjusted in the Y-direction by means of, for example, screws 14 provided with finger nuts, which screws protrude through slots 15. There is an elongated slot 16 which extends in the X-direction of the plate 7, and a peg 17 protrudes upwardly through the slot 16. The peg is fixed on an endless belt 18, which can be moved in the X-direction by means of a second stepping motor 28 (FIG. 4). The write head 3 can be adjusted manually in relation to the plate 7 so that the best marking result is obtained. This is achieved by the telescopically displaceable arm 4, the position of which can be fixed with a wheel 19. The write head can be adjusted in height by raising or lowering the clamp and its optimum position is locked by the locating screw 20** of the clamp.

Figure 3:
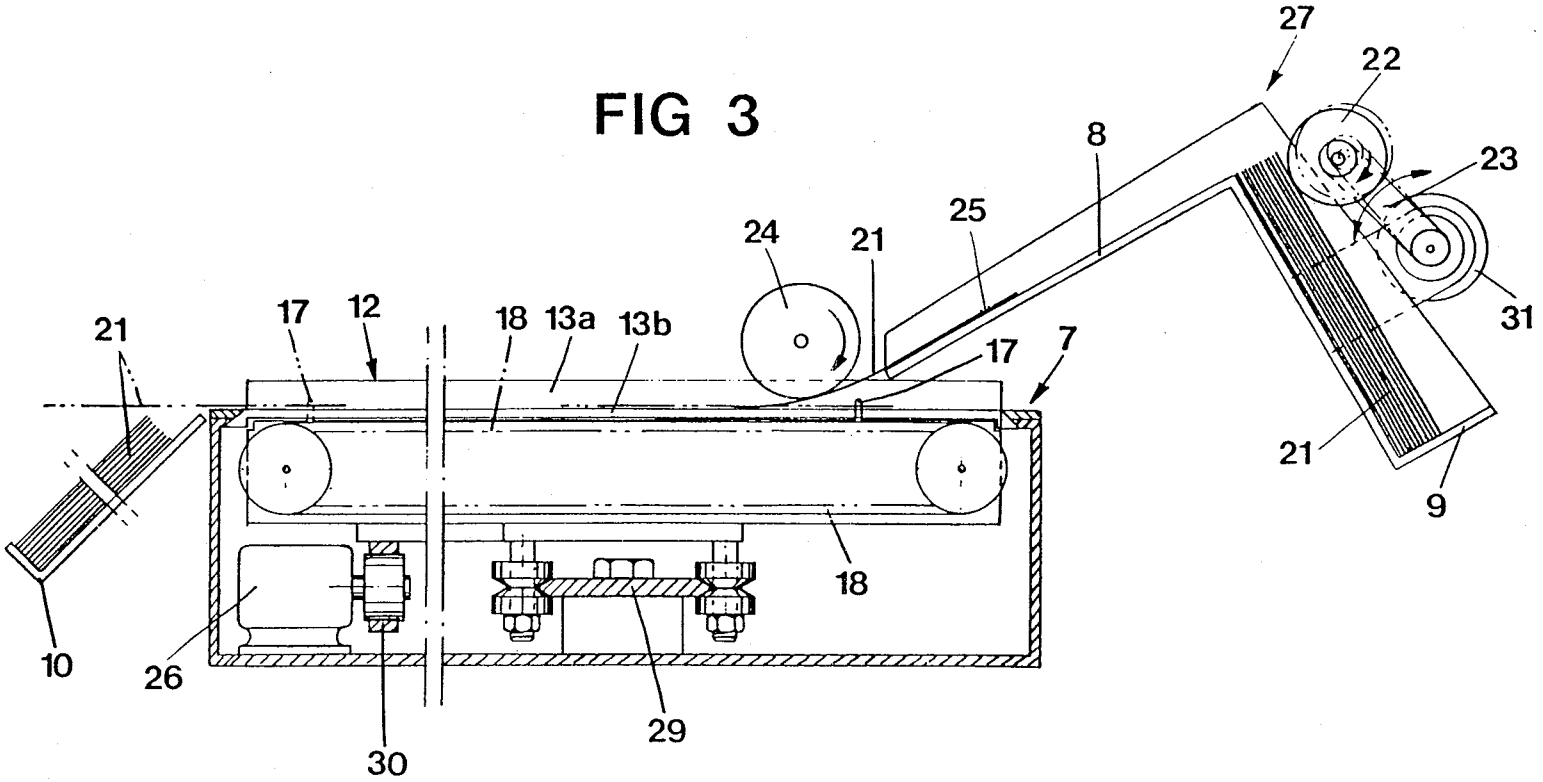
FIG. 3 is a sectional view, on an enlarged scale, of part of the device of FIG. 1.

In FIG. 3 is shown more in detail how the feeder 27 for the sheets 21 is constructed. In the magazine 9, which is inclined downwardly from the slide track 8, a number of sheets 21 have been placed, which one at the time are to be fed into the apparatus by means of a feeding wheel 22 carried on a pivoted arm 23. When a sheet has been lifted up high enough by the wheel 22, the sheet falls down by its own weight on the slide track 8 and slides forward to a driving wheel 24, which rotates clockwise and pulls the sheet further forward. The sheet will thereby, with its front edge, cling to the side shanks **13*b* of the rules 12, and since the driving wheel 24 is placed so that its forwarding surface is located below the lower end edge of the slide track 8, the sheet 21 will become somewhat bent. This bending results in a good grip being obtained between the driving wheel 24 and the sheet 21. When the sheet 21 has advanced so far that its rear end slides off the slide track 8, the rear edge of the sheet "snaps" down against the exactly positioned peg 17, which peg thereby engages in a hole 25 in the sheet 21. The hole 25 can be one of the many holes which normally can be found on the sheet 21** which are used for fastening of a marking label on a wire or the like, which marking label is removable from the sheet.

When feeding forward a sheet from the magazine 9 the feeding wheel 22 will, just before the sheet leaves the magazine, feed forward parts of the next sheet. In order to be able to control the initial position of the sheets the driving means 31 for the feeding wheel 22 is reversible. In the wheel 22 a retaining mechanism is located, which allows the wheel only to rotate in one direction as illustrated by the arrow in FIG. 3. With a short reverse of the driving means 31 the arm 23 will be lifted away from the sheet 21, so that a sheet which has been fed too far can slide back to its initial position.

The sheet 21 is now effectively guided along a guide path by the rules 12 and is adjustable along the rules to an exact position by means of the peg 17. When marking the sheet 21 the sheet is advanced by means of the belt 18 and the peg 17 in X-direction and by means of the plate 7 and the rules 12 in Y-direction. With lightweight material for the plate, the belts, the peg and other components displacements can be carried out very fast. When the marking is completed, the sheet 21 is advanced toward the other end of the rules 12 facing away from the magazine 9, and when the sheet 21 has advanced far enough over the edge of the rules it tilts over and ends up in the collecting receptacle 10.

In the embodiment described and shown in the drawings the guide means for the displacement of the sheet includes the peg 17, but it is also possible to choose for guiding means a frame or box corresponding to the shape of the sheets, in which box or frame the sheets are fed in the above described way.

The invention is not limited to the above described embodiments, but a number of alternative embodiments are possible within the scope of the claims.

I claim:

1. In a device for marking comparatively stiff, bendable sheets by means of a stationary write head: a guide assembly providing a longitudinal guide path for the sheets relative to the write head; a magazine for holding a supply of sheets; means for feeding sheets one at a time from the magazine; at least one guide member for cooperating with sheets fed to the guide path; drive means for moving said guide member along the guide path so as to advance a sheet along the guide path; a slide track having a discharge end arranged above the guide path, said slide track being inclined downwardly toward the guide path in the sheet-advancing direction and thereby having an upper, sheet-receiving end, said magazine being inclined in the opposite direction from said slide track and being located adjacent the upper end of said slide track, and said means for feeding sheets one at a time including a driven feeding wheel for engaging the uppermost sheet of a stack of sheets in said magazine; and a driving wheel located above the guide path, the driving wheel having a lower surface located below and downstream of said discharge end of said slide track for feeding the advance edge of a sheet along the guide path until the rear edge of the sheet leaves the slide track and is completely located on the guide path and in cooperation with said guide member.

2. A device as in claim 1 wherein said guide member is a peg for cooperating with a hole in each sheet.

3. A device as in claim 1 wherein said feeding wheel is supported at one end of an arm for rotation in only one direction, said feeding means further including a reversible drive for said feeding wheel such that when the drive reverses, said arm rotates so as to move said feeding wheel away from the stack of sheets.

4. A device as in claim 2 wherein said guide peg is carried by an endless belt and wherein there is a sheet-collecting receptacle arranged below the level of said guide path.

* * * * *